United States Patent [19]

Suzaki

[11] 4,405,246

[45] Sep. 20, 1983

[54] HAMMER DEVICE FOR PRINTER

[75] Inventor: Masayuki Suzaki, Tokyo, Japan

[73] Assignee: Ricoh Company, Ltd., Tokyo, Japan

[21] Appl. No.: 311,118

[22] Filed: Oct. 14, 1981

[30] Foreign Application Priority Data

Oct. 21, 1980 [JP] Japan ..... 55-147482

[51] Int. Cl.[3] ..... B41J 9/38

[52] U.S. Cl. ..... 400/144.2; 101/93.48; 400/157.2

[58] Field of Search ..... 400/144.2, 166, 157.2, 400/157.3; 101/93.48; 335/238, 258, 262, 263, 270, 273, 274

[56] References Cited

U.S. PATENT DOCUMENTS 3,201,659 8/1965 Poulton, Jr. et al. ..... 335/274
3,265,941 8/1966 Lory et al. ..... 335/274
3,707,214 12/1972 Ponzano ..... 400/144.2
4,037,532 7/1977 Plaza et al. ..... 400/157.2 X
4,267,897 5/1981 Takeshima ..... 335/262

FOREIGN PATENT DOCUMENTS 2347640 4/1975 Fed. Rep. of Germany ... 400/144.2

*Primary Examiner*—Paul T. Sewell
*Attorney, Agent, or Firm*—David G. Alexander

[57] ABSTRACT

A hammer device for a printer includes a hammer bullet which is made up of a detent and a rectangular rigid part. One lateral edge of the rigid part is slidably guided by flanged rotary bearings located at a reference side while the other lateral edge is slidably guided by another flanged rotary bearing located at the opposite side. This causes the hammer bullet to perform true translation toward and away from a type wheel so that the detent is engagable with a desired fount detent to print a character of an excellent quality.

7 Claims, 23 Drawing Figures

HAMMER DEVICE FOR PRINTER

BACKGROUND OF THE INVENTION

The present invention relates to hammer devices for printers.

Serial printers equipped with a series of character types are now in wide use for printing ordinary letters in offices as well as for printing computer and telex output data. Today, there is a keen demand for a printer which is operable at a high speed to reproduce data of a good quality, in connection with the development of word processors in particular.

A quality printer may be one which prints out characters at exact predetermined pitches and with an even density both in each character and throughout characters. To print characters accurately at predetermined pitches, a carriage must be precisely positioned in the transverse direction at each printing position and, for this purpose, a servo motor system is utilized which is capable of accurate positioning control. The positioning accuracy also depends on the accuracy of division or circumferential spacings between adjacent ones of multiple fingers which are arranged radially on a type wheel. However, considering production on industrial basis, type wheels cannot avoid some errors in the accuracy of division or some deformation of their fingers.

With the above in view, a hammering structure with detent means is employed particularly for a daisy type wheel in which the accuracy of division is of prime importance. Specifically, a fount detent in the form of a projection (or a recess) is positioned on the back of each type on a type wheel in alignment with the center axis of the type. A hammer assembly on the other hand has at its front end a detent portion in the form of a recess (or a projection) complementary in shape to the fount detent. When the detent on the hammer assembly is driven into mating contact with a selected fount detent on the type wheel, a corresponding character is printed with the type wheel located accurately in its printing position. The hammer assembly has to perform translation toward the type wheel, involve a minimum of lateral oscillation and be excellent in its durability and ability to follow high-speed operations. None of hammer structures heretofore proposed or put to practical use have been successful in fully meeting such requirements.

Another known type of hammer assembly employs a hammer having a fulcrum of rotation. This type of hammer assembly, however, encounters difficulty in aligning the direction of hammer to fount contact direction with the printing direction of a fount during a printing action. Though the printing position may be accurately regulated, a character becomes uneven in the density distribution due to local contact of the hammer with a fount resulting in poor quality data recording.

SUMMARY OF THE INVENTION

In accordance with the present invention, a hammer device for a printer comprises a hammer bullet which is made up of a detent and a rectangular rigid member. The rigid member of the hammer bullet is slidably guided at one end by flanged rotary bearings located at a reference side and at the other edge by another flanged rotary bearing located at the opposite side. This permits the hammer bullet to translate toward a type wheel so that the detent is engaged with a fount detent, allowing the printer to print a character of a favorable quality.

It is an object of the present invention to provide a hammer device for a printer which enables a hammer bullet having a detent engagable with a fount detent to move in translation thereby minimizing lateral oscillation of the hammer bullet and achieving an excellent quality of characters.

It is another object of the present invention to provide a generally improved hammer device for a printer.

Other objects, together with the foregoing, are attained in the embodiment described in the following description and illustrated in the accompanying drawings.

DESCRIPTION OF THE PREFERRED EMBODIMENT

While the hammer device for a printer of the present invention is susceptible of numerous physical embodiments, depending upon the environment and requirements of use, substantial numbers of the herein shown and described embodiment have been made, tested and used, and all have performed in an eminently satisfactory manner.

Figure 1:
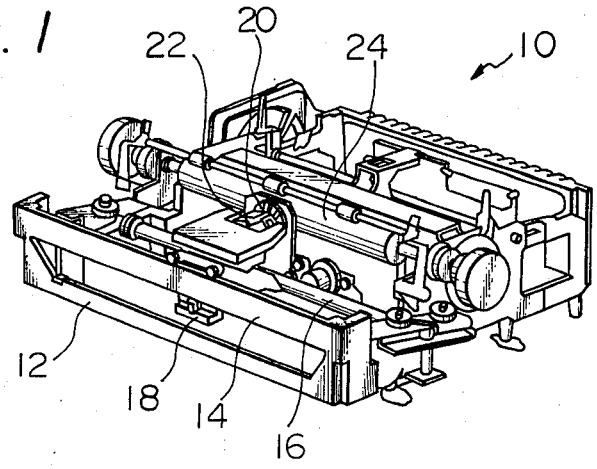
FIG. 1 is a perspective view of a serial printer to which the present invention is applicable.

Referring to FIG. 1 of the drawings, there is shown a serial printer 10 to which the hammer device of the present invention is applicable. The printer 10 comprises a frame 12 which consists of a die casting and includes a guide strip 14. A carrier 18 is reciprocatably mounted on the guide strip 14 and a guide rod 16 which is rigidly mounted on the frame 12. The carrier 18 supports thereon a carriage 22 on which a type head in the form of a petal-shaped type wheel 20 is removably mounted. A platen 24 extends substantially horizontally in an intermediate portion between front and rear ends of the frame 12.

Figure 5:
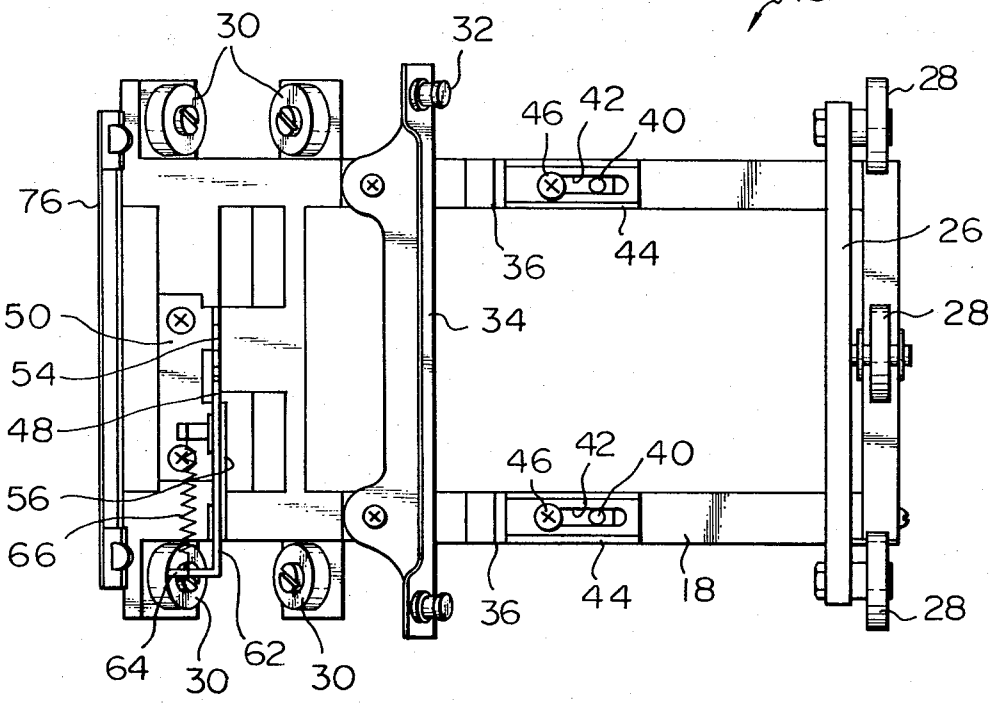
FIG. 5 is a plan view of a carrier also installed in the printer of FIG. 1.
Figure 6:
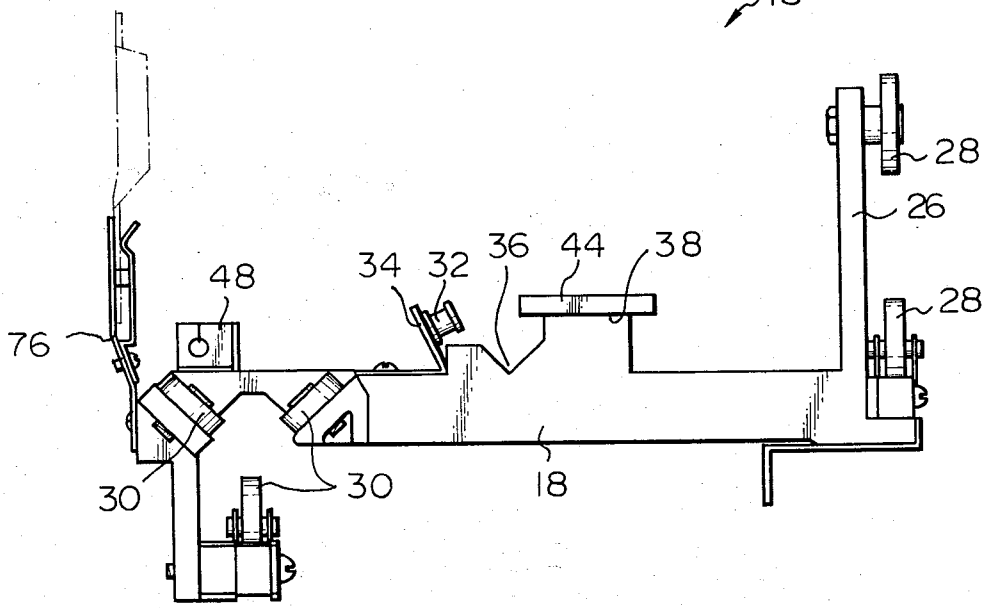
FIG. 6 is a side elevation of the carrier.

Referring to FIGS. 5 and 6, the carrier 18 comprises a die casting which forms a generally square frame as viewed in a top plan. A flat vertical roller mount 26 is formed integrally with a rear end portion of the carrier 18. These rollers 28 are rotatably mounted on the roller mount 26 to abut against the guide strip 14 of the frame 12, two from above and one from below. Other three rollers 30 are rotatably mounted in a front portion of the carrier 18 in contact with upper and lower portions of the guide rod 16. A drive plate 34 is mounted in the intermediate between the front and rear ends of the carrier 18. Pins 32 are studded on the drive plate 34 to retain a drive wire (not shown). The carrier 18 is formed in its intermediate portion with a pair of transversely aligned generally V-shaped recesses 36 which have their open ends faced upward to be engaged by the carriage 22. Flat faces 38 extend rearward from the rear edges of the respective V-shaped recesses 36 while pins 40 are studded on the flat faces 38, respectively. Retainers 44 are movably mounted on the individual flat faces 38 with the pins 40 on the flat faces 38 engaged in their elongate slots 42. The retainers 44 will be fastened to the flat faces 38 by screws 46 so as to firmly nip a shaft of the carriage 22 as will be described. A carriage setting mechanism 48 is located in a front portion of the carrier 18.

Figure 7:
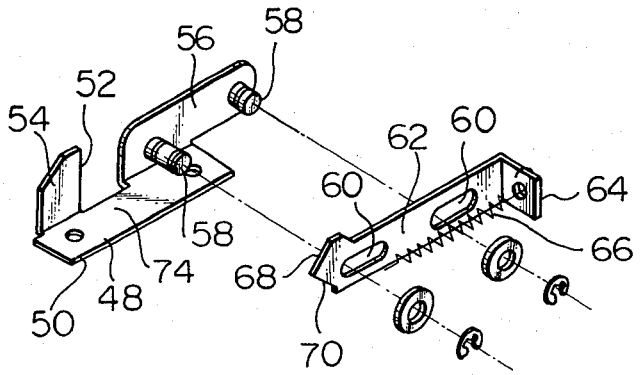
FIG. 7 is an exploded perspective view of a part of a carriage setting mechanism in the printer of FIG. 1.
Figure 8:
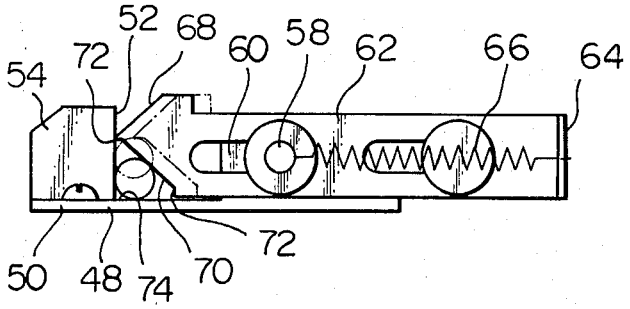
FIG. 8 is an enlarged front view showing a part of the carriage setting mechanism of FIG. 7.

As seen in FIGS. 7 and 8, the carriage setting mechanism 48 comprises a generally L-shaped base plate 50 which is rigidly connected to the carrier 18. The base plate 50 has a reference piece 54 formed with a vertical reference edge 52 and a retainer piece 56 offset rearwardly from the reference piece 54 by a distance equal to the thickness of the base plate 50. Guide pins 58 project forward from the front surface of the retainer piece 56. A slider 62 is formed with two horizontal elongate slots 60 in which the guide pins 58 on the retainer piece 56 are received, respectively. Thus, the slider 62 is movable transversely along and relative to the retainer piece 56 within a limited range. The slider 62 is constantly biased toward the reference piece 54 by a tension spring 66 which is anchored at one end to the pin 58 adjacent to the reference piece 54 and at the other end to a bent end 64 of the slider 62. That end of the slider 62 which is adjacent to the reference piece 54 is formed with a tip at which an upwardly inclined edge 68 and a downwardly inclined edge 70 terminate. The lower end of the edge 70 connects to a short flat face 72. The upper surface of the base plate 50 serves as a reference surface 74 on which a locking pin will rest.

As viewed in FIGS. 5 and 6, the carrier 18 also supports a resilient member 76 in a front end thereof. The resilient member 76 will function to retain a card holder thereon.

Figure 4:
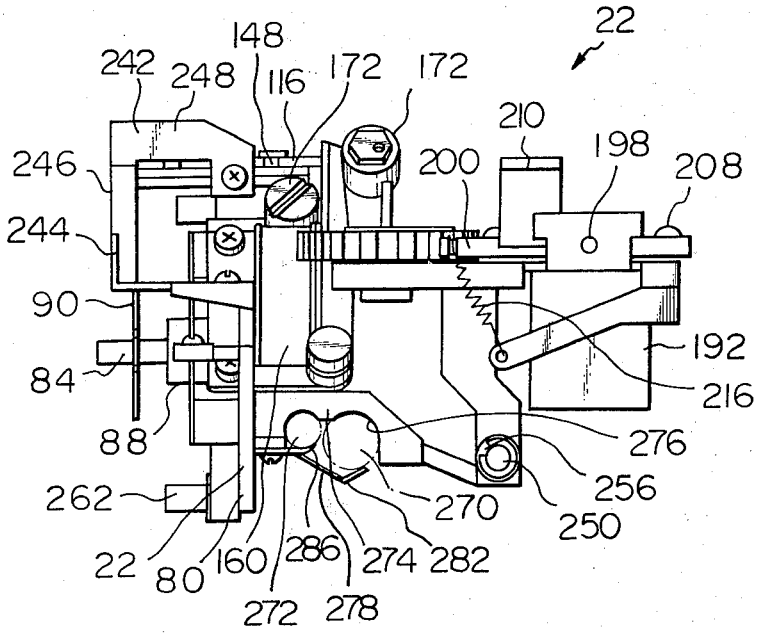
FIG. 4 is a side elevation of the carriage.
Figure 2:
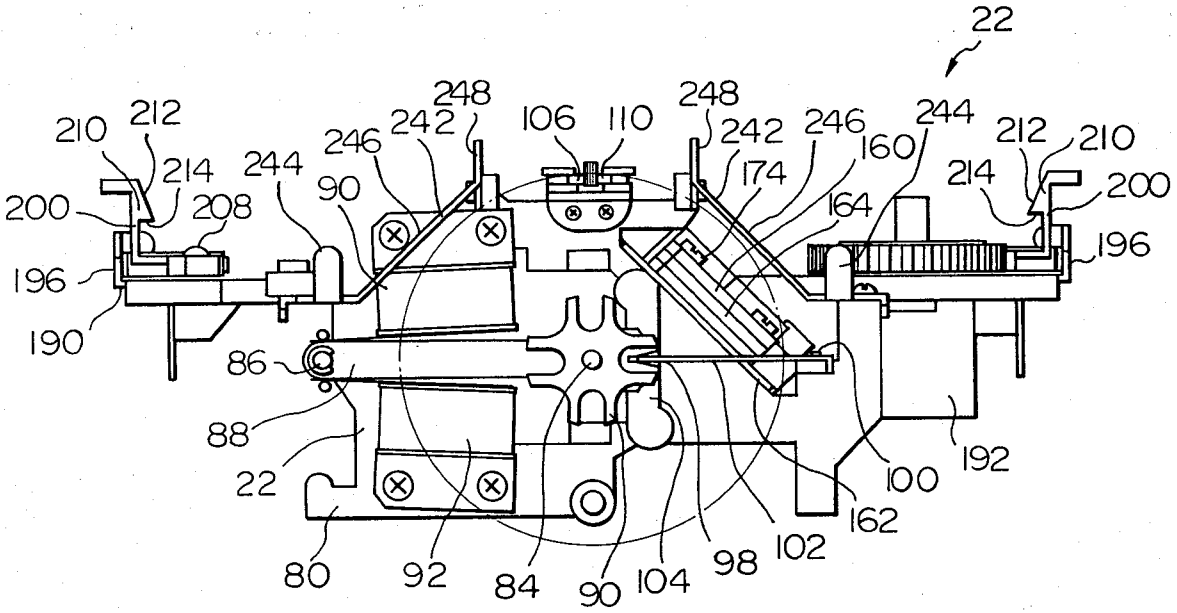
FIG. 2 is a front view of a carriage installed in the printer of FIG. 1.
Figure 3:
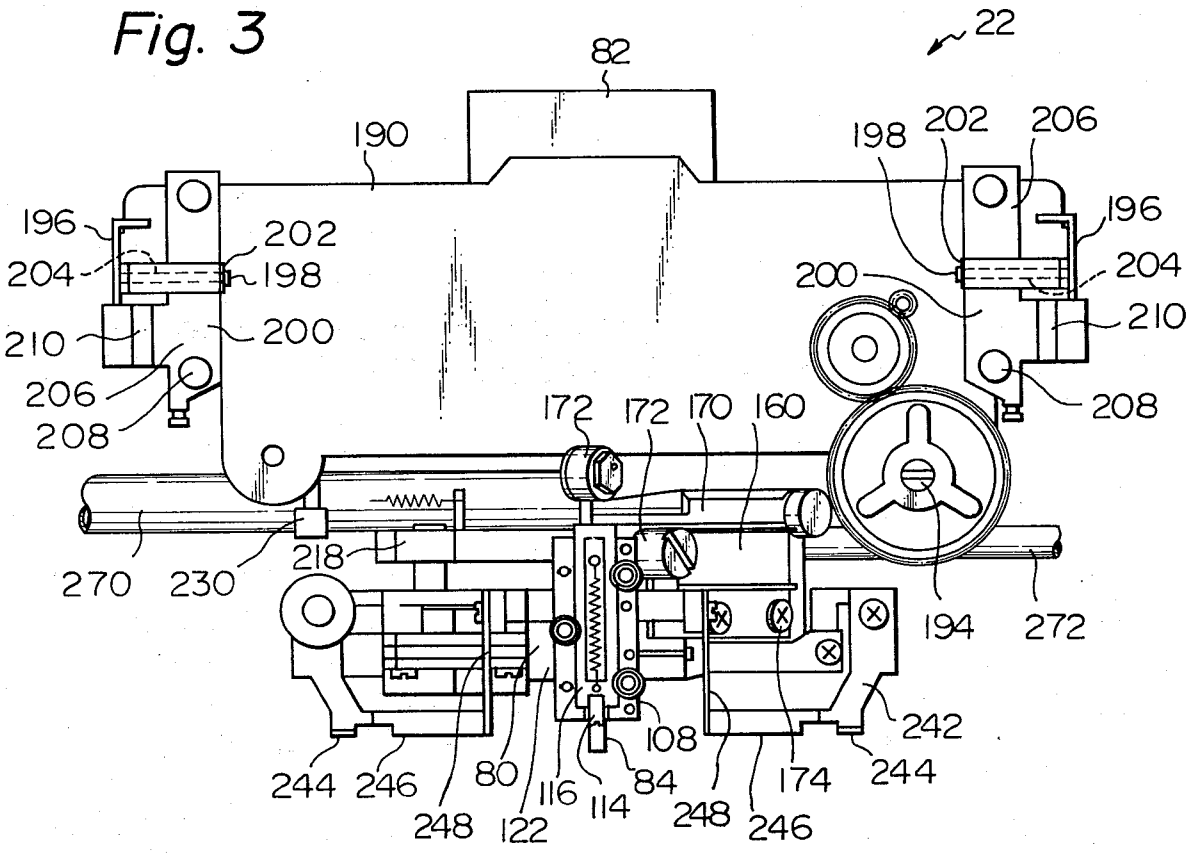
FIG. 3 is a plan view of the carriage.
Figure 13:
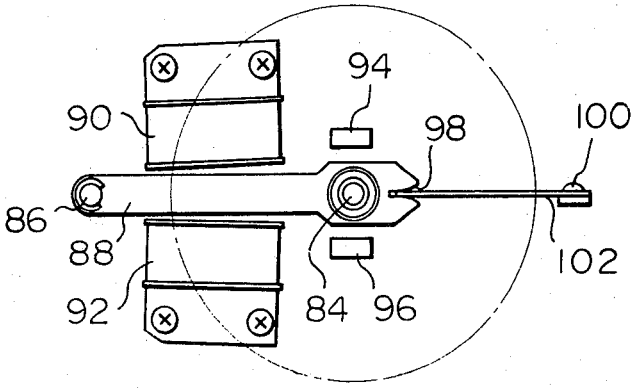
FIG. 13 is a front view of a drive shaft shifting mechanism.

Referring to FIGS. 2–4, the carriage 22 comprises a body 80 in the form of a die casting. A motor 82 is mounted in a centeral lower portion of the frame 80 while a drive shaft 84 is operatively connected with an output shaft of the motor 82 by a universal joint (not shown). The drive shaft 84 is supported by an arm 88 the other end of which is rotatably supported on a shaft 86. A cruciform retainer 90 is mounted on the front end of the drive shaft 84 to retain the type wheel 20. A magnetic piece is carried on an intermediate portion of the arm 88 for cooperation with magnets 90 and 92 which are fixed in place above and below the arm 88, respectively. As shown in FIG. 13, stops 94 and 96 are located to define upper and lower limits of a movement of the arm 88, respectively. As also shown in FIG. 13, the end of the arm 88 remote from the shaft 86 is slotted as at 98 to receive one end of a leaf spring 102 the other end of which is secured to the body 80 by a screw 100. Each of the leaf spring 102 and arm 88 has its mating end vertically split into two parts and engages with a vertical guide member 104 rigid on the body 80 from both sides, thus being prevented from oscillation in the longitudinal direction.

Figure 14:
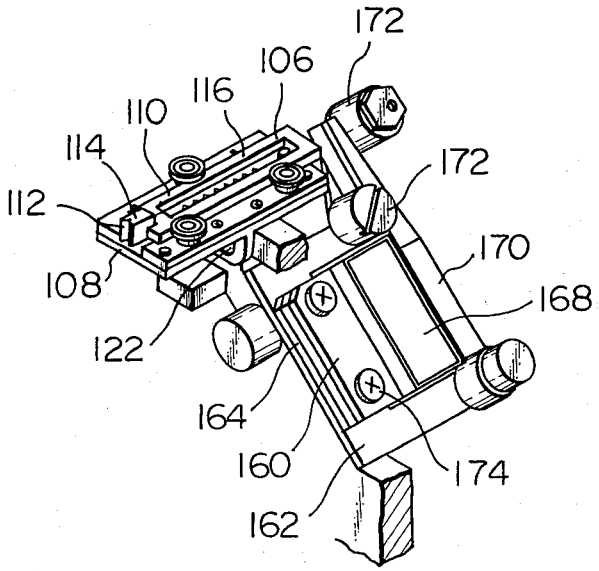
FIG. 14 is a perspective view of a hammer assembly.
Figure 15:
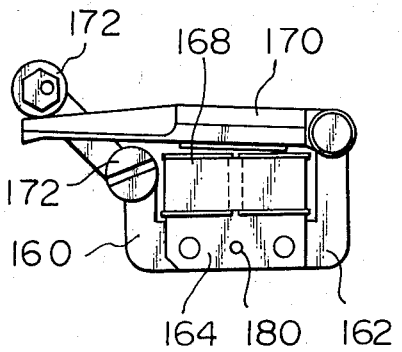
FIG. 15 is a plan view of a magnet assembly.
Figure 16:
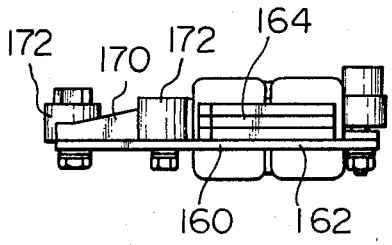
FIG. 16 is a front view of the magnet assembly.
Figure 17:
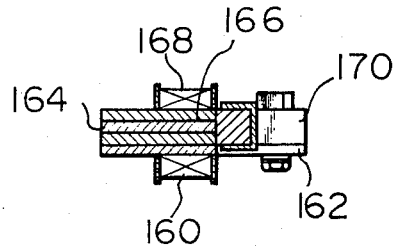
FIGS. 17 and 18 are sectional views of the magnet assembly.
Figure 22:
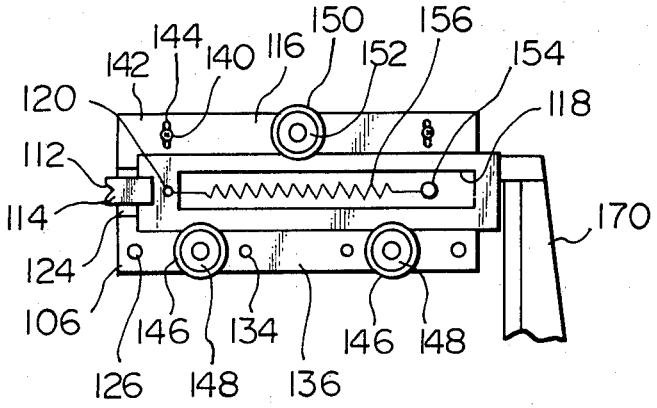
FIG. 22 is an enlarged plan view of the hammer assembly.
Figure 23:
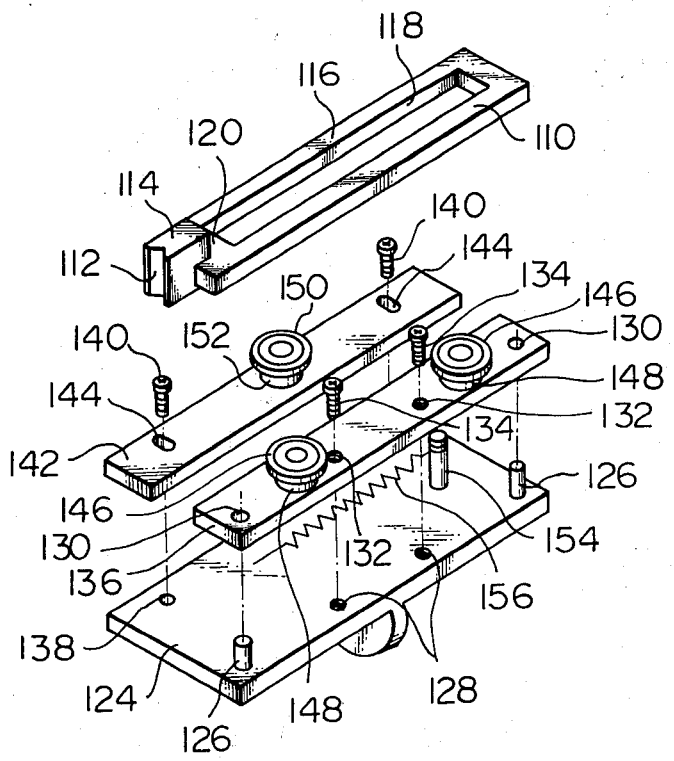
FIG. 23 is an exploded perspective view of the hammer assembly.

A hammer assembly 106 is mounted in a front upper portion of the body 80. As shown in detail in FIGS. 14, 22 and 23, the hammer assembly 106 is made up of a guide member 108 and a hammer bullet 110. The hammer bullet 110 comprises a main drive plate 116 which serves as a rectangular rigid part of the hammer bullet 110. The drive plate 116 is formed with a rectangular opening 118 in its central portion and an aperture 120 in its portion adjacent to one end. The hammer bullet 110 also comprises a detent 114 which is secured to said one end of the drive plate 116 perpendicularly to the general plane of the drive plate 116. The detent 116 is formed with a vertical generally V-shaped groove 112 which is to mate with a convex fount detent on the type wheel 20. The guide member 108 on the other hand comprises a holder 124 which is generally T-shaped as viewed in a side elevation and mounted to the body 80 by screws 122. Positioning pins 126 are studded on one side of the holder 124. Threaded holes 128 are formed in the holder 124 in between the positioning pins 126. A guide plate 136 is secured to said one side of the holder 124 by screws 134 which are passed through threaded holes 132 in the guide plate 136 and the threaded holes 128 in the holder 124. In this instance, the pins 126 on the holder 124 are engaged in corresponding holes 130 in the guide plate 136 to accurately position the guide plate relative to the holder 124. A second guide plate 142 is fastened to the other side of the holder 124 by screws 140 in parallel and spaced relation with the guide plate 136. For this purpose, the holder 124 is formed with another set of threaded holes 138. The screws 140 extend through elongate slots 144 in the second guide plate 142 into the holes 138 in the holder 142. This permits the guide plate 142 to slide toward and away from the fixed guide plate 136 and be fastened in an optimum position. Two ball bearings 148 are mounted on the guide plate 136 to serve as rotary bearings. The ball bearings 148 are engaged by one side edge of the drive plate 116; a line tangential to the inner peripheries of the ball bearings 148 defines a reference line directed toward the type wheel 20. The ball bearings 148 are provided with flanges 146 which cooperate with the major surface of the guide plate 136 to vertically position the drive plate 116. Another ball bearing 152 with a flange 150 is mounted on the guide plate 142 to also serve as a rotary bearing. This ball bearing 152 is so arranged as to form one apex of an equilateral triangle the other two apexes of which are defined by the two ball bearings 148. The flange 150 of the ball bearing 152 and the upper surface of the guide plate 142 cooperate to vertically position the drive plate 116 at the other side. The hammer bullet 110 is constantly biased rearwardly by a return spring 156 which is retained at one end in the aperture 120 of the drive plate 116 and at the other end by a pin 154 studded in a central rear portion of the holder 124.

Figure 18:
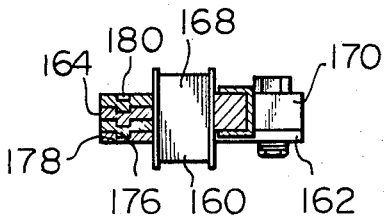

A magnet assembly 160 is mounted on the rear end of the hammer assembly 106. As seen in FIGS. 15–18, the magnet assembly 106 comprises a base plate 162 formed of iron and a plurality of yokes 164 formed of silicon steel stacked on the base plate 162. Two cores 166 of identical leg shapes extend from the base plate 162 and yokes 164. Coil 168 are wound around the individual cores 166. An armature 170 is swingably mounted on one side of the base plate 162 while two stops 172 are mounted on the other side to define a swingable range of the free end of the armature 170. The stops 172 consist of eccentric shafts which can be rotated to desired positions and fixed thereat to set up an optimum swingable range of the armature. The base plate 162 and yokes 164 are formed with through holes through which screws 174 are passed to fasten them to the body 80 (see FIG. 14). The base plate 162 and yokes 164 are used as an integral stack. Concerning their relative positioning, the base plate 162 is formed with a hole 176 while each yoke 164 is formed with a projection 178 and a recess 180 by a knockout process. The base plate 162 and yokes 164 are then stacked one upon another with their horizontal positions regulated as best shown in FIG. 18.

Figure 19:
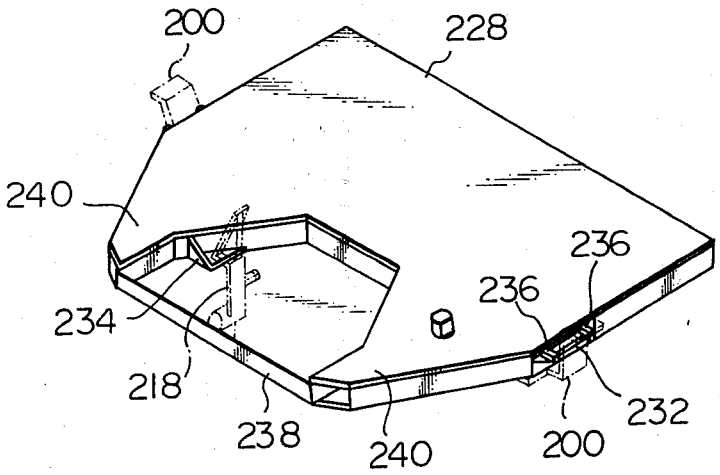
FIG. 19 is a perspective view of a ribbon cartridge.
Figure 20:
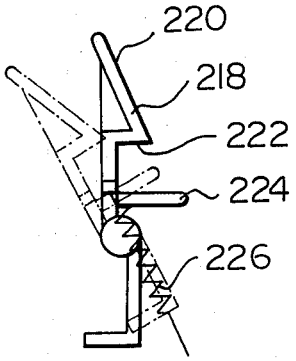
FIG. 20 is a rear view of an upper stop.
Figure 21:
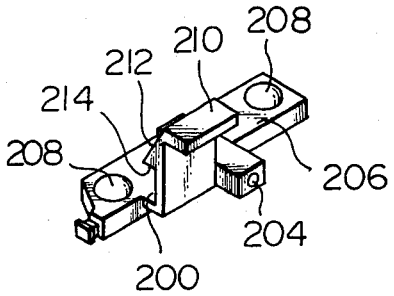
FIG. 21 is a perspective view of a retainer for retaining the ribbon cartridge.

As indicated in FIGS. 2–4, a ribbon cartridge mounting plate 190 is fixed flat on a rear upper surface of the body 80 of the cartridge 22. A ribbon drive motor 192 is mounted on the underside of one side of the mounting plate 190 and held in mesh with a ribbon drive shaft 194. Upright walls 196 extend from opposite sides of the mounting plate 190 in facing relation. Stubs of a predetermined length 198 extend on a common axis from the walls 196 toward each other. A resilient retainer member 200 formed of plastics is swingably mounted on each stub 198 and retained thereon by a snap ring 202. As seen in FIG. 21, the retainer 200 comprises a pair of resilient arms 206 extending in opposite directions away from a bore 204, through which the corresponding stub 198 extends. Elastic abutment members 208 formed of rubber or the like are carried on the outboard ends of the respective arms 206. A resilient locking tongue 210 extends upwright from one of the arms 206 and has at its upper end a slant 212 and a locking lug 214. Each retainer 200 thus constructed is constantly biased by a tension spring 216 such that its front end tends to move downward (see FIG. 4). As viewed in FIG. 20, an upper stop 218 is pivotally mounted in a central portion of the body 80 in such a manner as to be engagable with a front part of a ribbon cartridge which will be described. The upper stop 218 comprises a slant 220, a locking shoulder 222 and a lug 224. A toggle spring 226 maintains the upper stop 218 stationary either in its locking position indicated by a solid line or in its releasing position indicated by a phantom line. Denoted by the reference numeral 230 (FIG. 3) are lift levers (only one is visible) which are mounted on the body 80 to function to face a ribbon cartridge upward interlocked with a lifting mechanism (not shown) as will be described. A ribbon cartridge 228 (FIG. 19) is generally U-shaped and formed at each side with an outward lug 232 with which a locking lug 214 on the retainer 200 is engagable and an abutment 234 with which the upper stop 218 is engagable. Walls 236 are positioned on both sides of the lug 232 to properly locate the locking lug 214 in the longitudinal direction. An inked ribbon 238 is stored in the cartridge 228 and partly exposed between opposite front leg portions 240.

As shown in FIGS. 2–4, a pair of ribbon guides 242 are located on the body 80 at both sides of the hammer assembly 106. Each ribbon guide 242 is secured to the body 80 at opposite ends thereof and formed with a lug 244 for receiving the resilient card holder 76 at its lower front portion. The robbon guide 242 also has a ribbon guide surface 246 in its intermediate portion and a grip 248 at its upper portion.

Figure 9:
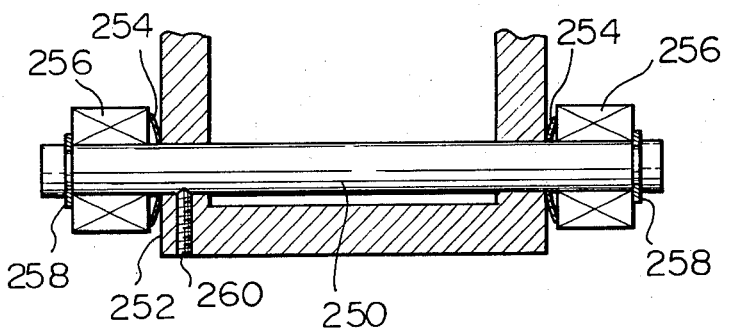
FIG. 9 is a vertically sectional front view of a rod for supporting the carriage and its associated parts.
Figure 10:
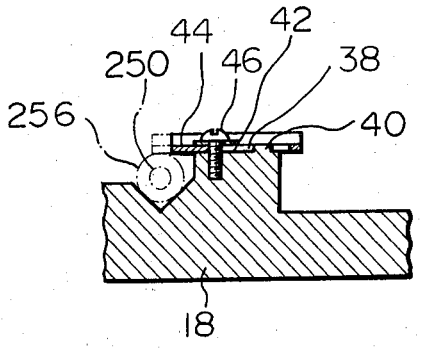
FIG. 10 is a vertically sectional side elevation showing an area where the carriage is fastened to the carrier.

As viewed in FIGS. 9 and 10, a rod 250 extends throughout and is fixed to a lower intermediate portion of the body 80. Each end of the shaft 250 protruding from the body 80 carries a bearing 256 thereon with a corrugated washer 254 interposed between the bearing 256 and the adjacent side wall 252 of the body 80. A snap ring 258 is coupled on the outboard end of the rod 250 to prevent the bearing 256 from slipping out. A screw 260 is threaded through the body 80 into the shaft 250 to check lateral movements of the shaft 250. A locking pin 262 extends from a central front portion of the body 80 to be engagable with the carriage setting mechanism 48 (see FIG. 4).

Figure 11:
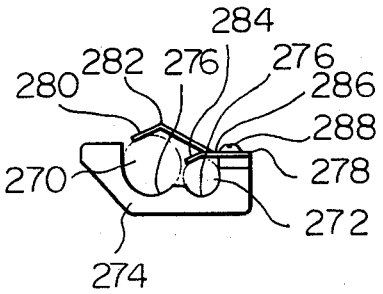
FIG. 11 is a vertically sectioned side elevation of a wire retaining portion.
Figure 12:
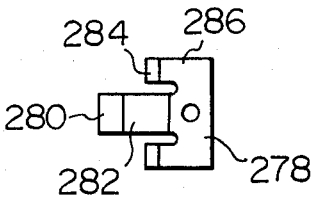
FIG. 12 is a plan view of a wire retainer member.

The carriage 22 is provided with leads electrically connected with a drive system and leads electrically connected with a detection and control system. As shown in FIGS. 4, 11 and 12, these leads are bundled up in a drive wire 270 and a control wire 272 which are individually shielded from each other to avoid mutual interference. As shown in FIGS. 11 and 12, the drive wire 270 and control wire 272 are snugly received in conjugate arcuate recesses 276 which are formed in a wire holder 274 which is rigid on the body 80. The wires 270 and 272 are secured in the recesses 276 from above by a resilient retainer 278 having a longer tongue 282 and a pair of shorter tongues 286 at opposite sides of the longer tongue 282. The resilient member 278 may comprise a thin sheet of copper for example. The inboard longer tongue 282 is adapted to retain the larger drive wire 270 with its bent end 280 while the outboard shorter tongues 286 are adapted to retain the smaller control wire 272 with their bent ends 284.

Now, the carrier 18 is reciprocatably mounted on the frame 12 of the printer 10 and the carriage 22 is removably mounted on the carrier 18, both in the following procedure. First, the bearings 256 on the shaft 250 are layed in the V-shaped recesses 36 in the frame 18 and loosely fastened therein by the retainers 44 to be still movable laterally. The grips 248 of the ribbon guides 242 are held by hand to push the front portion of the assembly downwardly until the locking pin 262 rests on the reference surface 74 of the base plate 50 pushing aside the slider 62 of the mechanism 48. Under this condition, the slant 70 on the slider 62 presses the pin 262 against the reference face 52 on the reference piece 54. The carriage 22 is in this way accurately positioned in both the vertical and horizontal directions. Then, the bearings 256 in the V grooves 36 are firmly secured to the carrier 18 for thereby completely mounting the carriage 22 to the carrier 18. It is notable here that the snap rings 258 prevent separation of the bearings 256 from the shaft 250 while the corrugated washers 254 absorb any dimensional error between the side walls 252 of the body 80 and the bearings 256. Positioning the carriage 22 is therefore positive without needing any high dimensional precision.

This also permits the type wheel 20 to be replaced by another with ease. For replacement, the grips 248 are held by hand and pulled upward so that the carriage 22 faces upward rotating about the shaft 250. After replacement, the grips 248 will be pushed downwardly to reset the carriage 22 in the horizontal position. Due to the presence of the flat edge 72 on the slider 62, the operator will feel clicking when the carriage 22 is faced upward. This has a favorable psychological effect concerning the touch during manipulation. In a printer of the type which pushes up the carriage 22 slightly to change the line, the carriage 22 is prevented from springing up due to inertia when so pushed up.

The ribbon cartridge 228 is loaded in a predetermined position on the carriage 22 merely by pushing it downward from above until the retainers 200 bend themselves and have their locking lugs 214 engaged with the lugs 232 on the ribbon cartridge 228. Where the upper stop 218 is in the locking position, the ribbon cartridge 228 enagages with the slant 220 of the upper stop 218 to move it to the releasing position; if the upper stop 218 is in the releasing position, it engages with the lug 224 of the upper stop 218. Thus, the shoulder 222 of the upper stop 218 is brought into a position above the abutment 234 on the ribbon cartridge 228. A certain spacing is defined between the abutment 234 and the shoulder 222 in this position. During a printing action of the printer, the front end of the ribbon cartridge 228 is lifted by the lift levers 230. In this instance, the abutment 234 of the ribbon cartridge 228 will abut against the locking shoulder 222 to be thereby prevented from moving upward any further. It will thus be seen that, when the ribbon cartridge 228 shifts up or down, the ribbon cartridge 228 itself and the retainer 200 alone move and the resultant very small moving mass or weight minimizes vibration or the like of the hammer device.

The type wheel 20 is movable between an upper position and a lower position to print out a desired kind of character. When the upper magnet 90 is energized, it attracts the magnetic piece on the arm 88 so that the arm 88 is pulled upwardly to locate the type wheel 20 in the upper position. When the lower magnet 92 is energized, the arm 88 is moved downwardly by the same mechanism to shift the type wheel 20 to the lower position. The type wheel can thus be provided with types twice larger in number than the fingers on the type wheel. The arm 88 is constantly biased by the leaf spring 102 to its neutral position. To minimize the required capacity of each magnet 90 or 92 and balance the shifts of the type wheel 20 to the opposite positions, it is necessary that the spring constant of the leaf spring 102 is reasonably small while constant forces are exerted to move the type wheel 20 up and down. Considering gravity, that is, weights of the component parts concerned, the neutral position is preselected at a point not the intermediate between the magnets 90 and 92 but somewhat higher than the same. Orientation of the leaf spring 102 toward the neutral position is readily achievable by presetting an orientation of the mounting section. Since the leaf spring is in its neutral position when unstressed and since the spring constant acts only in a linear manner, an attractive force required of each magnet 90 or 92 needs only be small causing no irregularity in the upward and downward shifts.

During a printing action, either the magnet 90 or the magnet 92 is necessarily energized as described above. Under this condition, when the coils 54 are energized, the armature 170 is attracted thereby to hit against the trailing end of the drive plate 116 to charge it forwardly. Then the detent 114 on the leading end of the drive plate 116 exerts an impact on the linked ribbon 238 and a paper sheet through the type wheel 20. The linked ribbon is located between the platen 24 and the type wheel 20. As a result, a character corresponding to the then selected type on the type wheel 20 is printed on the paper sheet.

To provide accuracy to such a printing action, the relative position and stroke relation between the drive plate 116 and armature 170 must be kept constant. The relative position of the hammer bullet 110 to the body 80 is determined by positioning the hammer assembly 106. Therefore, the hammer stroke is determined afterward by the magnet assembly 160. In detail, in the event of putting the magnet assembly 160 together, a range and angle of most efficient actions of the armature 170 can be determined by adjusting the stops 172 on the magnet assembly 160. It follows that adjustment of this section can be completed merely by properly locating the magnet assembly 160 relative to the drive plate 116 when the magnet assembly 160 properly conditioned beforehand is to be fasten to the body 80 by the screws 174. In short, the only adjustment needed is positioning the magnet assembly 160 relative to the drive plate 116 and which promotes easy and quick assembling work.

The drive wire 270 and control wire 272 each having leads bundled up together are firmly retained by the holder 278 at their base portions. These wires 270 and 272 are snugly received in the two conjugate arcuate recesses 276 in the holder 274 with their outer peripheries kept in intimate contact. This design requires a minimum of space for the wires 270 and 272. This will prove quite effective in apparatuses of this type in which a space available for wires is limited. This wire laying system is incomparable in space requirement with a prior art system which fastens wires one by one or another known system which allows set screws to intervene between wires though fastening the wires together. In the reciprocal carriage 22 for instance, the space occupied by the wires can be reduced throughout the width of the carriage with the resultant substantial decrease in the overall size. Additionally, two wires 270 and 272 are retained by a single holder 278 and this reduces the number of component parts while facilitating easy manufacture of the hammer device.

Concerning the hammer assembly 106, the drive plate 116 is positioned vertically by the guide plates 136 and 142 and the flanges 146 and 150 of the bearings; the guide plates 136 and 142 limiting the position of the underside of the plate 116 while the flanges 146 and 150 regulating oscillation of the plate 116. In the lateral direction, the ball bearing 148 guides that side of the drive plate 116 which serves as a reference for translation while the ball bearing 152 avoids lateral oscillation of the drive plate 116. In so positioning the drive plate 116, it will be recalled that the guide plate 142 is movable laterally toward and away from the guide plate 136. With the vertical and lateral oscillation thus precluded, the drive plate 116 performs only translation toward and away from the type wheel 20 in accordance with the actions of the armature 170. This ensures accurate positioning of the recess 112 in the detent 114 so that the front detent to be engaged by the recess 112 can be properly guided during a printing action. A finger on the type wheel 20 can thus be straightened if deformed in the production stages. The translation always occurs exactly relative to a position on the platen 24, precluding irregular density distribution in printed characters. Additionally, the spring 156 for returning the hammer bullet 110 does not interfere with the translation of the drive plate 116 since it is confined in the rectangular opening 118 of the drive plate 116.

In summary, it will be seen that the present invention provides a hammer device which can print characters of an excellent quality without any uneven density distribution. This is because a hammer bullet consists of a detent and a rectangular rigid member whose opposite lateral ends are guided by flanged rotary bearings at a reference side and a flange rotary bearing at the other side, so that the hammer bullet can always perform accurate translation toward and away from a type wheel. Also, a spring for returning the hammer bullet does not obstruct the translation of the rigid member since it is accommodated in an opening formed therein.

Various modifications will become possible for those skilled in the art after receiving the teachings of the present disclosure without departing from the scope thereof.

What is claimed is:

1. In a serial printer having a type wheel which is provided with a multiplicity of radially arranged fingers each carrying at least one type on a front face thereof and a fount detent on a back which is positioned coaxially with the type, a hammer device comprising:

(a) a support member mounted on a frame of a carriage;

(b) an impacting means movably mounted on said support member for translation between a first position where it is clear of a fount detent and a second position where it is engaged with the fount detent at one end thereof;

(c) guide means with which the impacting means are slidably engaged to be thereby guided during translation between the first and second positions;

(d) drive means for driving the impacting means from the first position to the second position;

(e) a tension spring for constantly biasing the impacting means toward the first position; and (f) positioning means for accurately positioning the impacting means in predetermined vertical and transverse orientations;

the guide means for guiding the translation of the impacting means comprising at least two rotary bearings each with a flange which constitute a reference side for the translation of the impacting means and at least one rotary bearing with a flange which defines the other side for the translation;

the positioning means comprising a first plate fixed in place on the support member and a second plate fixed in a place adjustable transversely toward and away from said first plate, said first plate carrying the two rotary bearings at the reference side thereon and said second plate the single rotary bearing so as to cooperate with the flanges of the rotary bearings.

2. A hammer device as claimed in claim 1, wherein the impacting means comprises a hammer bullet made up of a substantially rectangular rigid member and a detent member securely carried on one end of the rigid member perpendicular to the general plane of the support member, the detent member defining said one end of the impacting means and being formed with a vertically extending recess at its front end, the recess being configured to mate with a fount detent when the hammer bullet is driven to the second position so that a selected finger carrying said fount detent is located exactly in a printing position in a transverse direction.

3. A hammer device as claimed in claim 2, wherein the rigid member is formed with a substantially rectangular opening which defines a space for accommodating the tension spring therein, the tension spring being retained at one end by a pin studded on the support member and at the other end by an aperture formed in the rigid member adjacent to the detent member.

4. A hammer device as claimed in claim 1, wherein the drive means comprise an electromagnet and an armature which are so positioned that, when the electromagnet is energized, the armature is attracted thereby into hitting contact with the other end of the impacting means to propel the impacting means to the second position against the action of the tension spring.

5. A hammer device as claimed in claim 4, wherein a movable range of the electromagnet is optimally defined by a pair of stop means.

6. A hammer device as claimed in claim 5, wherein the stop means comprise a pair of adjustable eccentric shafts.

7. A hammer device as claimed in claim 1, in which the flanges of the rotary bearings are constructed to slidably retain the impacting means to the support member.

* * * * *